US008166590B2

(12) United States Patent
Ashrafzadeh et al.

(10) Patent No.: US 8,166,590 B2
(45) Date of Patent: May 1, 2012

(54) METHOD AND APPARATUS FOR DETERMINING LAUNDRY LOAD SIZE

(75) Inventors: Farhad Ashrafzadeh, Stevensville, MI (US); Ryan Robert Bellinger, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 458 days.

(21) Appl. No.: 12/424,629

(22) Filed: Apr. 16, 2009

(65) Prior Publication Data

US 2010/0263136 A1 Oct. 21, 2010

(51) Int. Cl.
*D06F 39/00* (2006.01)

(52) U.S. Cl. ..... 8/159; 8/137; 8/148; 68/139

(58) Field of Classification Search ..... None
See application file for complete search history.

(56) References Cited

U.S. PATENT DOCUMENTS

| | | | |
|---|---|---|---|
| 5,161,393 | A | 11/1992 | Payne et al. |
| 6,163,912 | A | 12/2000 | Matsuura et al. |
| 7,299,515 | B2 | 11/2007 | Oh et al. |
| 2004/0103485 | A1 | 6/2004 | Do et al. |
| 2005/0015890 | A1 | 1/2005 | Kim et al. |
| 2006/0021392 | A1 | 2/2006 | Hosoito et al. |
| 2006/0207299 | A1 | 9/2006 | Okazaki et al. |
| 2007/0022543 | A1 | 2/2007 | Lee |

FOREIGN PATENT DOCUMENTS

| | | | |
|---|---|---|---|
| DE | 4336350 | A1 | 4/1995 |
| DE | 19819554 | A1 | 11/1999 |
| DE | 102008055091 | A1 | 6/2010 |
| EP | 0536542 | A1 | 4/1993 |
| EP | 0704568 | A1 | 4/1996 |
| JP | 2008054960 | A | 3/2008 |
| JP | 2009056262 | A | 3/2009 |
| WO | 2005/085511 | A1 | 9/2005 |
| WO | 2008/003710 | A1 | 1/2008 |
| WO | 2008/053002 | A2 | 5/2008 |

OTHER PUBLICATIONS

German Search Report from corresponding DE102010016137, Feb. 6, 2012.

*Primary Examiner* — Michael Kornakov
*Assistant Examiner* — Eric Golightly
(74) *Attorney, Agent, or Firm* — Clifton G. Green; McGarry Bair PC

(57) ABSTRACT

A method and apparatus according to one embodiment for operating a laundry treating appliance includes determining a parameter representative of a rotational speed of laundry in a drum and determining a laundry load size based on the parameter.

51 Claims, 9 Drawing Sheets

METHOD AND APPARATUS FOR DETERMINING LAUNDRY LOAD SIZE

BACKGROUND OF THE INVENTION

Process settings for an operation cycle of a laundry treating appliance may depend on the size of a laundry load. In some laundry treating appliances, the user manually inputs a qualitative laundry load size (extra-small, small, medium, large, extra-large, etc.) through a user interface. However, it may be desirable to have the washing machine automatically determine the laundry load size because, for example, manual input may be perceived as inconvenient to the user and may result in inaccurate laundry load size determination due to the subjective nature of the estimation. Some known methods for automatic determination of the load size employ an output of the motor that drives a drum in which the laundry load is held in the laundry treating appliance. The output of the motor may be indicative of a quantitative size, such as mass or weight, of the laundry, which may then be quantified.

SUMMARY OF THE INVENTION

A method and apparatus for operating a laundry treating appliance having a drum configured to hold laundry includes determining a parameter representative of a rotational speed of the laundry in the drum and determining a laundry load size based on the parameter.

DESCRIPTION OF EMBODIMENTS OF THE INVENTION

Figure 1:
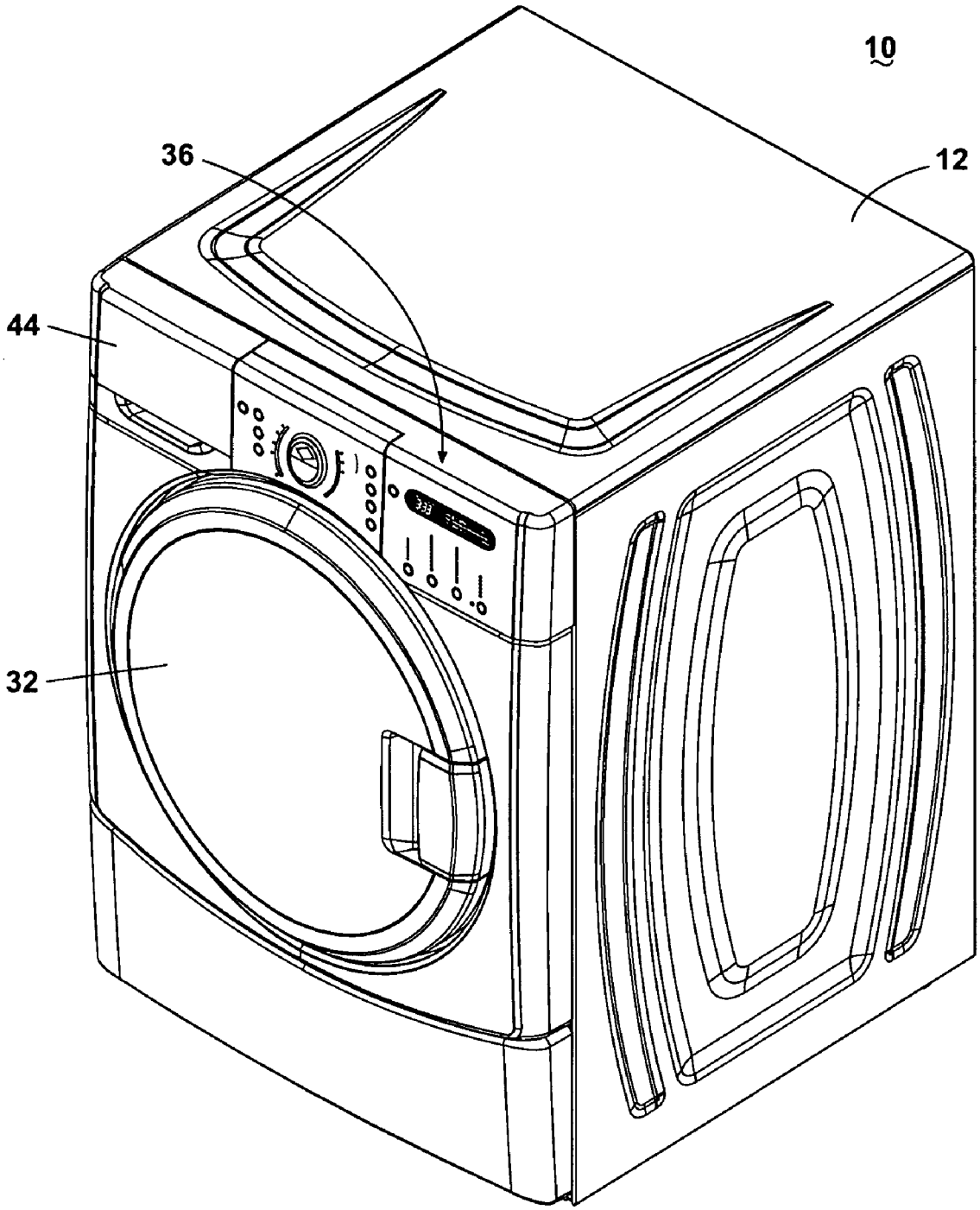
FIG. 1 is a perspective view of an exemplary laundry treating appliance in the form of a washing machine according to one embodiment.

Referring now to the figures, FIG. 1 is a perspective view of an exemplary laundry treating appliance in the form of an exemplary washing machine 10 according to one embodiment. The methods described herein may be used with any suitable laundry treating appliance and are not limited to use with washing machines, including the washing machine 10 described below and shown in the drawings. The washing machine 10 is described and shown for illustrative purposes. The laundry treating appliance may be any machine that treats fabrics, and examples of the laundry treating appliance may include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine. For illustrative purposes, the method will be described with respect to a washing machine with the fabric being a laundry load, with it being understood that the invention may be adapted for use with other types of laundry treating appliances for treating fabric.

Figure 2:
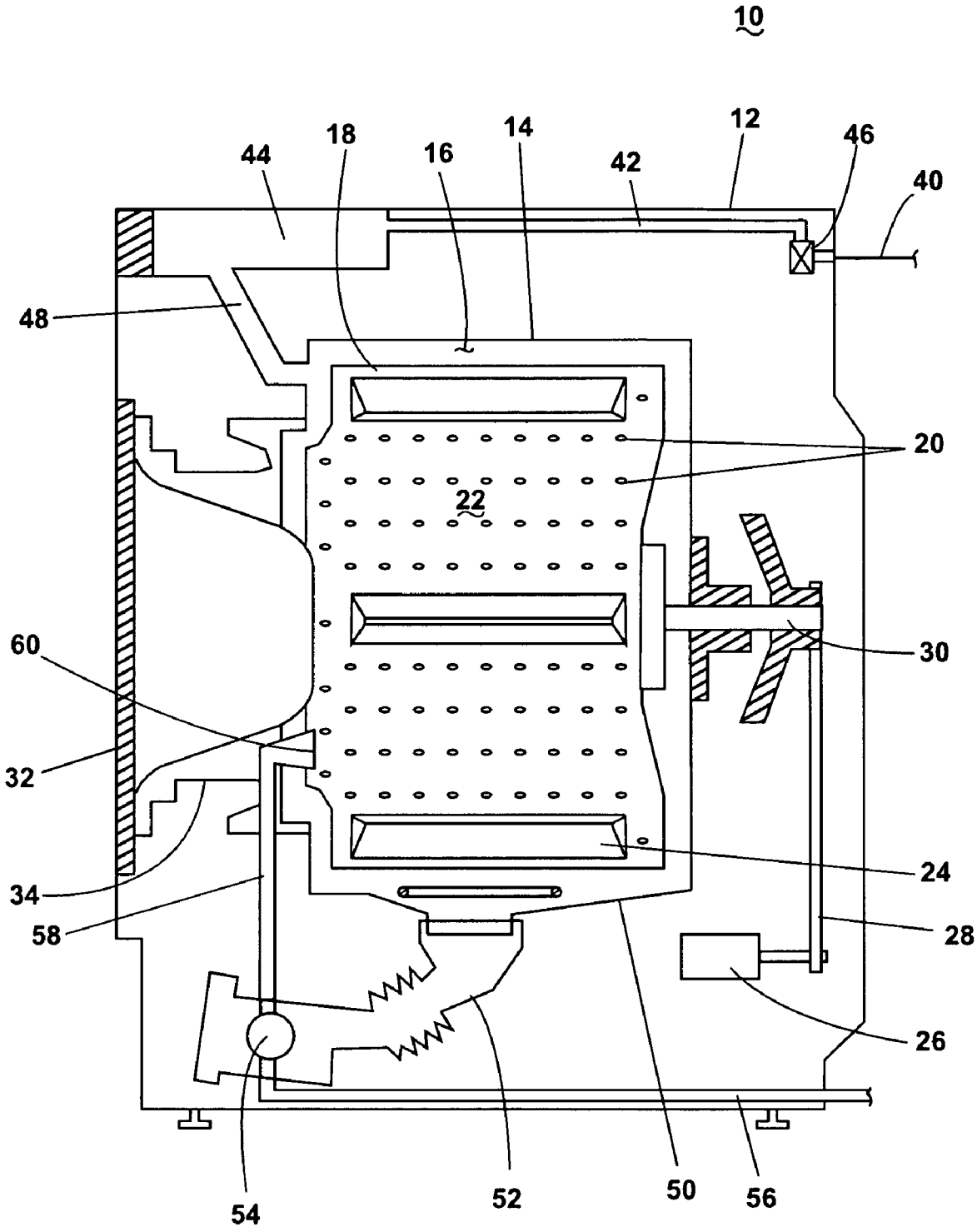
FIG. 2 is a schematic view of the washing machine of FIG. 1 according to one embodiment.

FIG. 2 provides a schematic view of the washing machine 10 of FIG. 1. The washing machine 10 of the illustrated embodiment may include a cabinet 12 that houses a stationary tub 14, which defines an interior chamber 16. A rotatable drum 18 may be mounted within the interior chamber 16 of the tub 14 and may include a plurality of perforations 20, such that liquid may flow between the tub 14 and the drum 18 through the perforations 20. The drum 18 defines a laundry treatment chamber 22 sized to hold a laundry load, which may have one fabric item or a plurality of fabric items. The drum 18 may further include a plurality of baffles 24 disposed on an inner surface of the drum 18 to lift the laundry load contained in the laundry treatment chamber 22 while the drum 18 rotates. A motor 26 may be coupled to the drum 18 through a belt 28 and a drive shaft 30 may rotate the drum 18. Alternately, the motor 26 may be directly coupled with the drive shaft 30, as is known in the art. The motor 26 may be a brushless permanent magnet (BPM) motor. Other motors, such as an induction motor or a permanent split capacitor (PSC) motor, may also be used. Both the tub 14 and the drum 18 may be selectively closed by a door 32. A bellows 34 couples an open face of the tub 14 with the cabinet 12, and the door 32 seals against the bellows 34 when the door 32 closes the tub 14. A control panel 36 (FIG. 1) with a user interface that may include one or more knobs, switches, displays, and the like for communicating with the user, such as to receive input and provide output.

While the illustrated washing machine 10 includes both the tub 14 and the drum 18, with the drum 18 defining the laundry treatment chamber 22, it is within the scope of the invention for the laundry treating appliance to include only one receptacle, with the receptacle defining the laundry treatment chamber for receiving the laundry load to be treated.

Washing machines are typically categorized as either a vertical axis washing machine or a horizontal axis washing machine. As used herein, the "vertical axis" washing machine refers to a washing machine having a rotatable drum that rotates about a generally vertical axis relative to a surface that supports the washing machine. In some vertical axis washing machines, the drum rotates about a vertical axis generally perpendicular to a surface that supports the washing machine. However, the rotational axis need not be perfectly vertical or perpendicular to the surface. The drum can rotate about an axis inclined relative to the vertical axis. As used herein, the "horizontal axis" washing machine refers to a washing machine having a rotatable drum that rotates about a generally horizontal axis relative to a surface that supports the washing machine. In some horizontal axis washing machines, the drum rotates about a horizontal axis generally parallel to a surface that supports the washing machine. However, the rotational axis need not be perfectly horizontal or parallel to the surface. The drum can rotate about an axis inclined relative to the horizontal axis, with fifteen degrees of inclination being one example of inclination.

Vertical axis and horizontal axis machines can sometimes be differentiated by the manner in which they impart mechanical energy to the laundry load. In vertical axis machines, a fabric moving element moves within the drum to impart mechanical energy directly to the laundry load or indirectly through wash liquid in the drum. In horizontal axis machines, mechanical energy is typically imparted to the laundry load by tumbling the laundry load resulting from rotating the drum. The tumbling involves repeated lifting and dropping of the fabric items in the laundry load. The illustrated exemplary washing machine of FIGS. 1 and 2 is a horizontal axis washing machine.

With continued reference to FIG. 2, the motor 26 may rotate the drum 18 at various speeds in either rotational direction. Depending on the physical characteristics of the washing machine 10, such as the size of the drum 18, and of the laundry load, the rotation of the drum 18 may result in various types of laundry load movement inside the drum 18. For example, the laundry load may undergo at least one of tumbling, rolling (also called balling), sliding, satellizing (also called plastering), and combinations thereof. The terms tumbling, rolling, sliding and satellizing are terms of art that may be used to describe the motion of some or all of the fabric items forming the laundry load. However, not all of the fabric items forming the laundry load need exhibit the motion for the laundry load to be described accordingly.

The motor 26 may rotate the drum 18 such that the laundry load tumbles. Tumbling is a condition in which the laundry load may be lifted by the rotating drum 18 from a lower position, generally near or at the bottom of the drum 18, to a raised position above the lower position, where the laundry load is no longer being lifted by the drum 18 and falls within the drum 18, generally toward the bottom of the drum 18. During tumbling, the individual fabric items in the laundry load may move relative to one another such that the fabric items may rub against each other and may fall onto each other as they fall to the lower position of the drum 18. The rotation of the fabric items with the drum 18 may be facilitated by the baffles 24.

The motor 26 may also rotate the drum 18 such that the laundry load undergoes rolling wherein the laundry load forms a ball-shaped mass that rotates with the drum 18. Rolling is a condition in which the laundry load may not be lifted by the drum 18 as the drum 18 rotates, such as occurs during tumbling, but rather rolls or rotates while part of the laundry load may still be in contact with the baffles 24. In this condition, a frictional force may be present that causes the laundry load to move in a rolling or folding manner with little or no motion above its horizontal position in the drum 18. The fabric items in the laundry load retain the form of the mass, which itself rolls or rotates essentially as a single body while the drum 18 rotates.

The motor 26 may rotate the drum 18 such that the laundry load slides. Sliding is another condition in which the laundry load may not be lifted by the drum 18 as the drum 18 rotates, such as occurs during tumbling, but may remain at or near the bottom of the drum 18. Sliding differs from rolling in that the laundry load does not move in a rolling or folding manner; rather, the laundry load slides off the inner surface of the drum 18 as the drum 18 rotates, generally exposing the same face of the laundry to the interior of the drum 18.

Alternatively, the motor 26 may rotate the drum 18 such that the laundry load sattelizes. Satellizing is a condition in which the laundry load may be held by centrifugal force against the inner surface of the drum 18 as the drum 18 rotates. Thus, the fabric items effectively stick to the drum 18 and rotate with the drum 18 without falling or without rotating independently of the drum 18.

The washing machine 10 of FIG. 2 may further include a liquid supply and recirculation system. Liquid, such as water, may be supplied to the washing machine 10 from a water supply 40, such as a household water supply. A supply conduit 42 may fluidly couple the water supply 40 to a detergent dispenser 44. An inlet valve 46 may control flow of the liquid from the water supply 40 and through the supply conduit 42 to the detergent dispenser 44. A liquid conduit 48 may fluidly couple the detergent dispenser 44 with the tub 14. The liquid conduit 48 may couple with the tub 14 at any suitable location on the tub 14 and is shown as being coupled to a front wall of the tub 14 in FIG. 2 for exemplary purposes. The liquid that flows from the detergent dispenser 44 through the liquid conduit 48 to the tub 14 typically enters a space between the tub 14 and the drum 18 and may flow by gravity to a sump 50 formed in part by a lower portion of the tub 14. The sump 50 may also be formed by a sump conduit 52 that may fluidly couple the lower portion of the tub 14 to a pump 54. The pump 54 may direct fluid to a drain conduit 56, which may drain the liquid from the washing machine 10, or to a recirculation conduit 58, which may terminate at a recirculation inlet 60. The recirculation inlet 60 may direct the liquid from the recirculation conduit 58 into the drum 18. The recirculation inlet 60 may introduce the liquid into the drum 18 in any suitable manner, such as by spraying, dripping, or providing a steady flow of the liquid.

The liquid supply and recirculation system may further include one or more devices for heating the liquid; exemplary devices include sump heaters and steam generators. Additionally, the liquid supply and recirculation system may differ from the configuration shown in FIG. 2, such as by inclusion of other valves, conduits, wash aid dispensers, sensors, such as water level sensors and temperature sensors, and the like, to control the flow of liquid through the washing machine 10 and for the introduction of more than one type of detergent/wash aid. Further, the liquid supply and recirculation system need not include the recirculation portion of the system or may include other types of recirculation systems.

Figure 3:
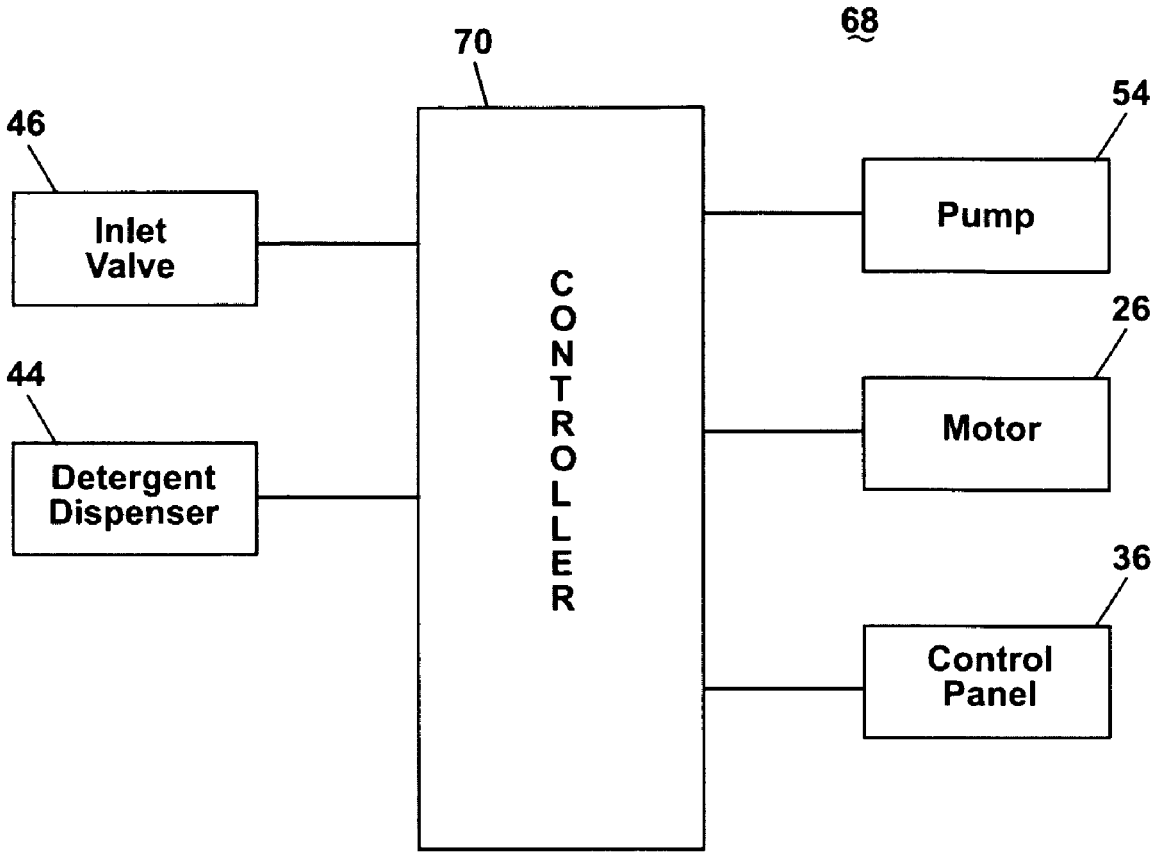
FIG. 3 is a schematic view of a control system according to one embodiment for the washing machine of FIGS. 1 and 2.

Referring now to FIG. 3, which is a schematic view of an exemplary control system 68 of the washing machine 10, the washing machine 10 may further include a controller 70 coupled to various working components of the washing machine 10, such as the pump 54, the motor 26, the inlet valve 46, and the detergent dispenser 44, to control the operation of the washing machine 10. The controller 70 may receive data from one or more of the working components and may provide commands, which can be based on the received data, to one or more of the working components to execute a desired operation of the washing machine 10. The commands may be data and/or an electrical signal without data. The control panel 36 may be coupled to the controller 70 and may provide for input/output to/from the controller 70. In other words, the control panel 36 may perform a user interface function through which a user may enter input related to the operation of the washing machine 10, such as selection and/or modification of an operation cycle of the washing machine 10, and receive output related to the operation of the washing machine 10.

Many known types of controllers may be used for the controller 70. The specific type of controller is not germane to the invention. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

A washing machine may perform one or more manual or automatic operation cycles, and a common operation cycle includes a wash process, a rinse process, and a spin extraction process. Other processes for operation cycles include, but are not limited to, intermediate extraction processes, such as between the wash and rinse processes, and a pre-wash process preceding the wash process, and some operation cycles include only a select one or more of these exemplary processes. Regardless of the processes employed in the operation cycle, the methods described below may relate to determining a size of the laundry load.

Figure 4:
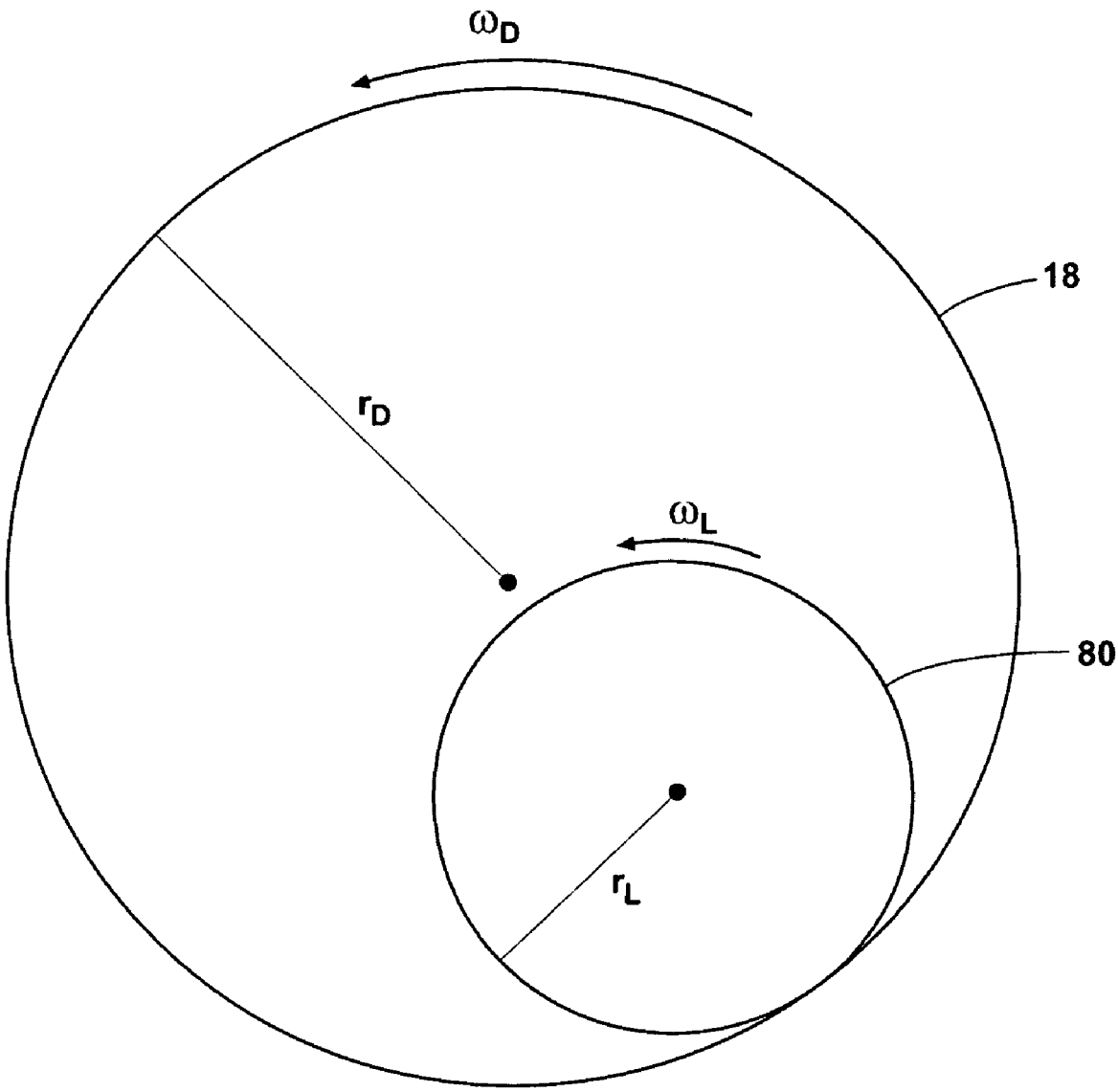
FIG. 4 is a schematic view of a drum of the washing machine from FIG. 1 and a laundry load inside the drum according to one embodiment.

Before specific embodiments of the methods are presented, a description of theory behind the methods may be constructive. Referring to FIG. 4, which is a schematic view of the drum 18 and a laundry load 80 in the drum 18, the methods involve a rotational speed of the laundry load 80 (indicated by $\omega_L$) resulting from rotation of the drum 18. The drum 18 may rotate at a rolling speed (indicated by $\omega_D$) such that, as described above, the laundry load 80 rotates with the characteristic of a collective, single body. While the laundry load 80 is illustrated in FIG. 4 as a circle, the laundry load 80 in reality need not assume such a shape; the actual shape of the laundry load 80 may depend on the size of the laundry load 80 and the types of fabric items in the laundry load 80. Regardless of the shape, the laundry load 80 rolls or rotates with the characteristic of a single body or at least as a body rotating sufficiently together to be able to characterize the rotating laundry load 80 as having a rotational speed while the drum 18 rotates.

The rotational speed of the laundry load 80 depends, at least in part, on the radius of the laundry load 80 (indicated by $r_L$). In general, as the mass of the laundry load 80 in a dry condition increases, a radius of the laundry load 80 also increases, and, further, as the radius of the laundry load 80 in the dry condition increases, the rotational speed of the laundry load 80 decreases. As the radius of the laundry load 80 approaches and reaches a radius of the drum 18 (indicated by $r_D$), the rotational speed of the laundry load 80 approaches and reaches the rotational speed of the drum 18. The relationship between the rotational speed of the laundry load 80 and the rotational speed of the drum 18 can be represented mathematically by:

$$\omega_L = \omega_D\left(\frac{r_D}{r_L}\right).$$

A comparison between the rotational speed of the laundry load 80 and the rotational speed of the drum 18 may be employed to determine a qualitative or quantitative size of the laundry load 80. In particular, a difference between the two rotational speeds may be indicative of the size of the laundry load 80; as the difference decreases, the size of the laundry load 80 increases. The difference may be compared to empirical data to determine the size of the laundry load 80.

The laundry load 80 may be dry or wet for the determination of the load size. In one embodiment, the laundry load 80 may be wet to facilitate maintaining the laundry load 80 as a single, collective body during rolling. Because a wet laundry load has substantially the same radius as the dry laundry load, the rotational speed of the wet laundry load is substantially the same as that of the dry laundry load. It follows that the rotational speed of the wet laundry load may be employed to determine the size of the dry laundry load. The size may be a qualitative size, such as small, medium, or large, or a quantitative size, such as the mass.

Figure 5:
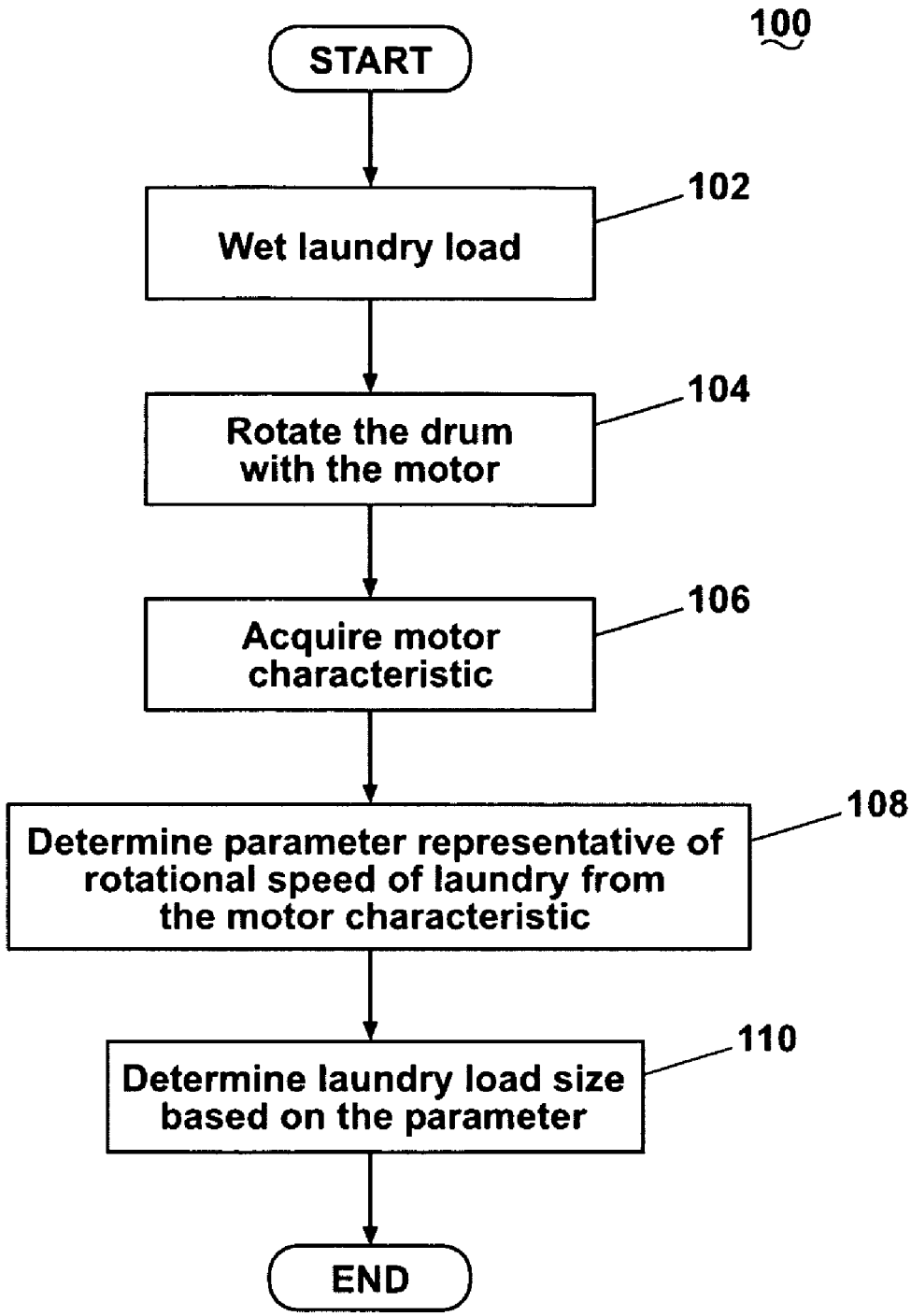
FIG. 5 is a flow chart for a method of determining load size according to one embodiment.

FIG. 5 provides a flow chart of an embodiment of a method 100 that employs the above theory for determination of load size. The sequence of steps depicted is for illustrative purposes only and is not meant to limit the method 100 in any way as it is understood that the steps may proceed in a different logical order, additional or intervening steps may be included, or described steps may be divided into multiple steps, without detracting from the invention. The method 100 may be incorporated into an operation cycle of the washing machine 10, such as during a pre-wash or wash process, or may be performed independently from an operation cycle.

The method 100 may begin with a step 102 of wetting the laundry load. As stated above, the wetting of the laundry load may be optional but is included in this embodiment for illustrative purposes. Referring to the washing machine 10 in FIG. 2, liquid, such as water from the water supply 40 or a combination of water from the water supply 40 and wash aid(s) from the detergent dispenser 44, may be supplied to the sump 50 or directly to the laundry load in the laundry treatment chamber 22 of the drum 18. When the liquid is supplied to the sump 50, the liquid may be supplied to a level to at least partially submerge the drum 18 such that the laundry load becomes wet by residing in the liquid and/or by rotating the drum 18 through the liquid. In one embodiment, the laundry load may be saturated during the wetting. The wetting of the laundry load may facilitate maintaining the laundry load as a single body while the drum 18 rotates.

Referring back to FIG. 5, the method 100 continues with a step 104 of rotating the drum 18. The rotating of the drum 18 may occur subsequent to or simultaneously with the wetting of the laundry load. In the washing machine 10 of FIG. 2, the motor 26 may drive the rotation of the drum 18. According to one embodiment, the motor 26 rotates the drum 18 at a steady state for at least a portion of the step 104. For example, the drum 18 may rotate according to a constant speed setpoint, wherein the motor 26 is controlled to rotate the drum 18 according to a constant speed while the actual speed of the drum 18 fluctuates about the constant speed setpoint due to the rotation of the laundry load in the drum 18 and imbalance in the laundry load.

The drum 18 may rotate at a speed suitable to induce rolling of the laundry load wherein the laundry load rotates within the drum 18 as a single body with substantially all of the fabric items rotating together. One or more of the fabric items may undergo independent movement relative to the single body, but the single body maintains an overall rotational movement within the drum 18. An exemplary range of rolling speeds for a drum having a 47.3 cm (18.6 in.) diameter is from about 40 to 54 revolutions per minute.

With reference back to FIG. 5, a step 106 of acquiring a characteristic of the motor 26 may occur subsequent to or simultaneously with the rotating of the drum 18 by the motor 26 in the step 104. The characteristic may be acquired for any suitable time period, and an exemplary time period is time required for a complete rotation of the drum 18. The characteristic of the motor 26 may be acquired in any suitable manner, such as with one or more sensors associated with the motor 26, via data related to control of the motor 26, such as data available from the controller 70 (FIG. 3) or other controller, such as a dedicated motor controller, and other known manners to obtain data related to the control of the motor 26 and output resulting from the operation of the motor 26. Further, the characteristic of the motor 26 may be any data related to the operation of the motor 26, such as motor torque, motor speed, motor current, and motor voltage; in the current embodiment, the characteristic of the motor 26 is the motor torque. The motor torque data or signal contains information that may be used to determine the size of the laundry load.

With continued reference to FIG. 5, the acquired motor characteristic may be employed to determine a parameter representative of the rotational speed of the laundry load in a step 108, and, in a step 110, the laundry load size may be determined based on the parameter. The parameter may be any suitable parameter and may be determined in any suitable manner.

Figure 6A:
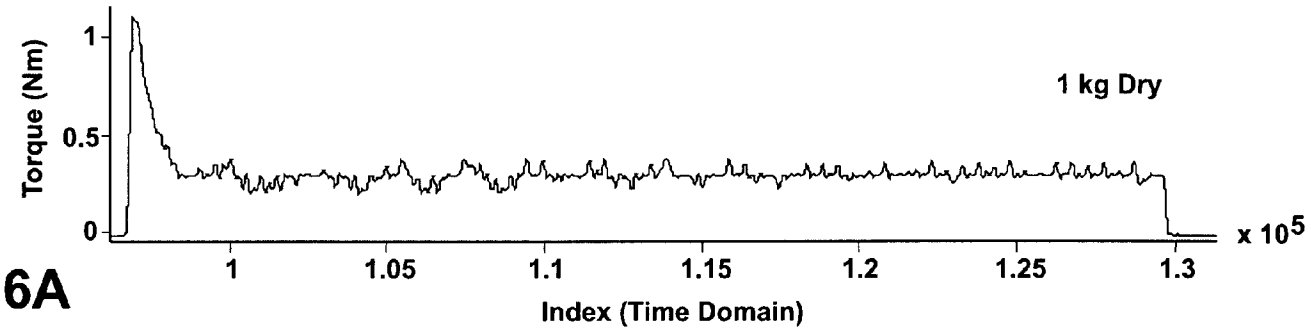
FIGS. 6A-6C are graphs of motor torque from a motor that drives the drum from the washing machine of FIG. 1, wherein the motor torque is shown in a time domain for laundry loads having a dry mass of about 1, 3, and 5 kg, respectively.
Figure 6B:
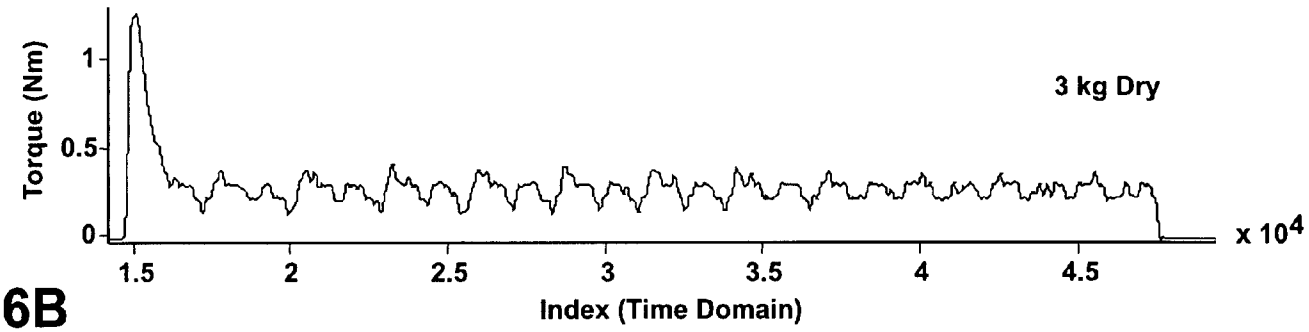
Figure 6C:
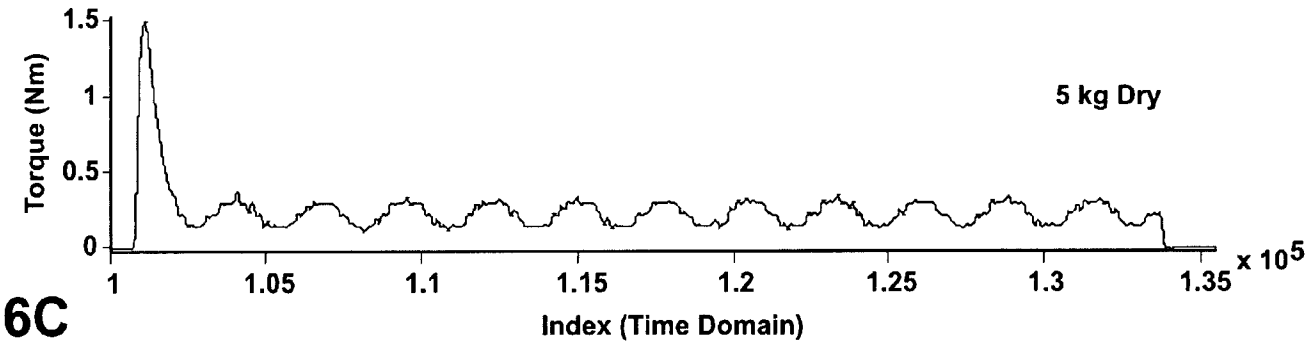

It has been discovered that the motor torque in the frequency domain is suitable for use in determining the parameter representative of the rotational speed of the laundry load in the step 108, especially as compared to the motor torque in the time domain. FIGS. 6A-6C show exemplary experimental data of the motor torque as a function of time (i.e., in the time domain) for 1, 3, and 5 kg dry mass polyester laundry loads, respectively. In the graphs, the time axis (i.e., the x-axis) is provided as an "Index" rather than "Time" due to the manner of recording experimental data. Except for the 5 kg laundry load in FIG. 6C, no clear periodic or useful content related to motion of the laundry load in the drum 18 can readily be seen in the time domain. In contrast, it has been discovered that the motor torque data in the frequency domain indeed contains useful information, as will be described in detail below.

Figure 7A:
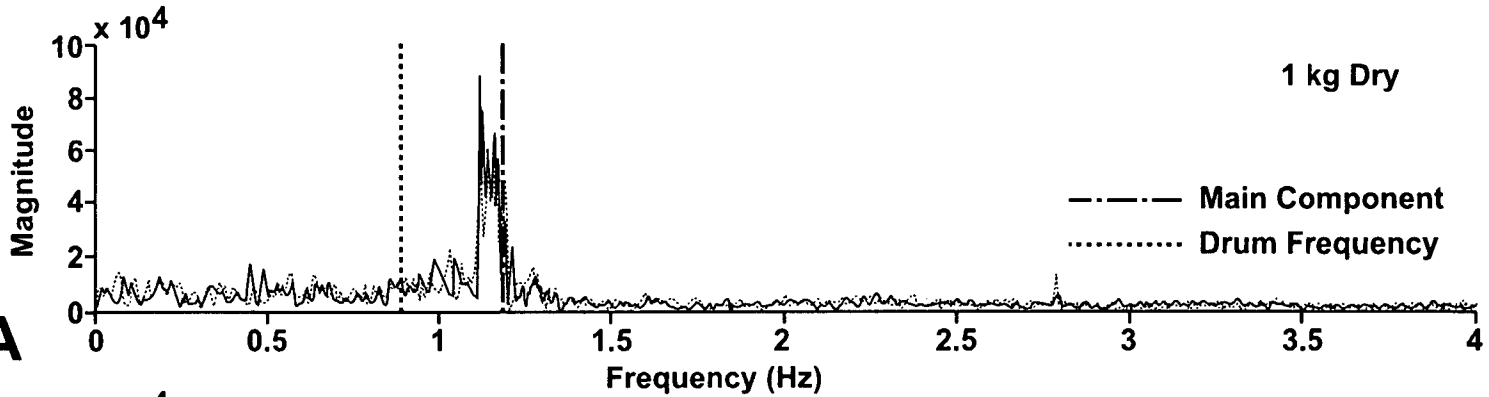
FIGS. 7A-7C are graphs of motor torque from a motor that drives the drum from the washing machine of FIG. 1, wherein the motor torque is shown in a frequency domain for laundry loads having a dry mass of about 1, 3, and 4 kg, respectively.
Figure 7B:
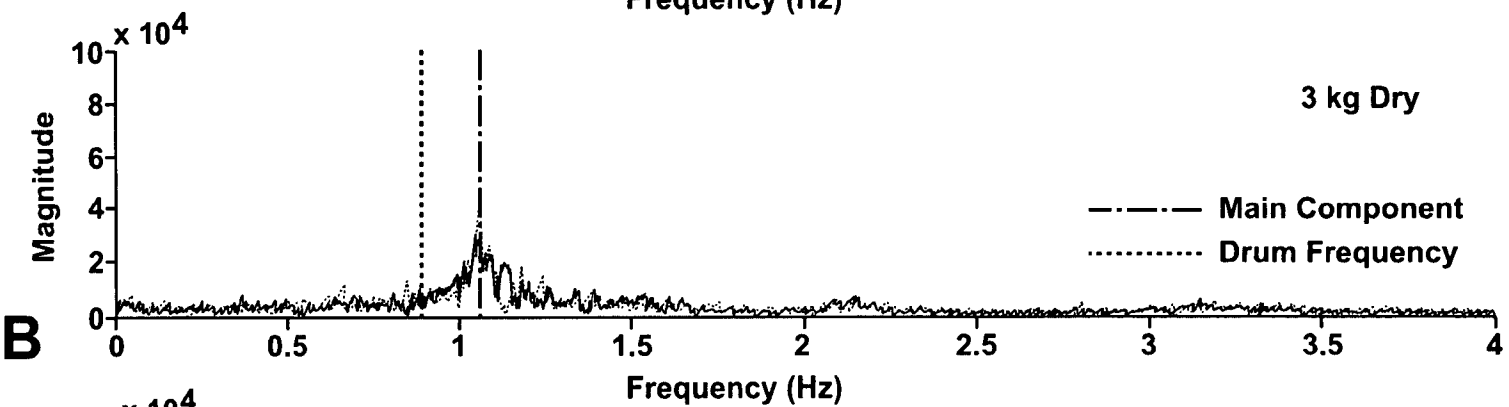
Figure 7C:
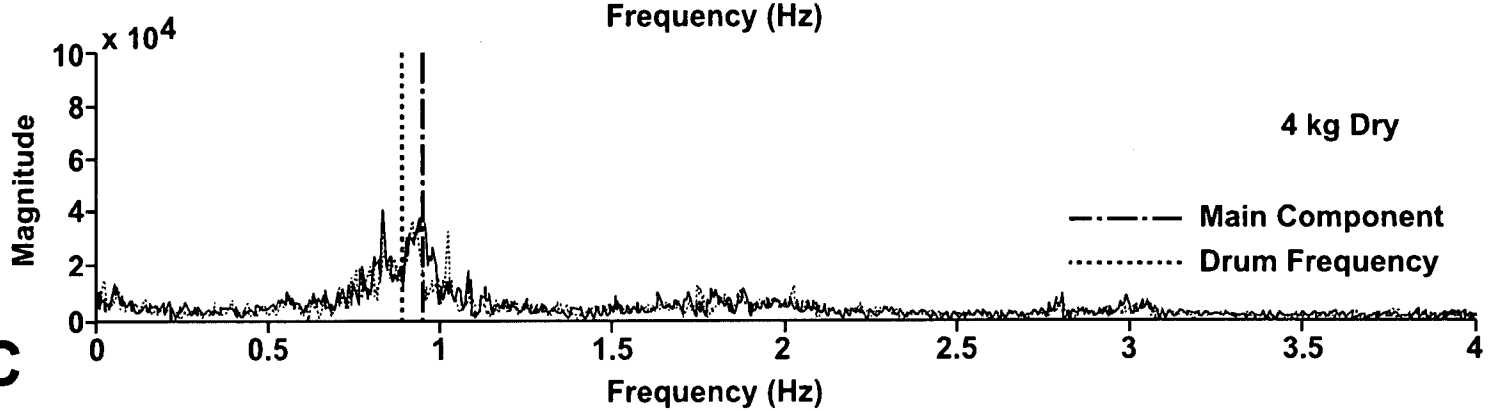

The motor torque data may be converted to the frequency domain by employing, for example, mathematical methods, such as a Fast Fourier Transform (FFT), as will be described in more detail below. FIGS. 7A-7C provide graphs of the magnitude of the FFT as a function of frequency (i.e., the steady state motor torque data in the frequency domain) for 1, 3, and 4 kg dry mass terry towel laundry loads. Each graph includes two sets of data to show reproducibility of the method and, more importantly, an apparent and useful data peak corresponding to the frequency of the rotating laundry load. With the motor torque data converted to the frequency domain, the frequency of or rotational speed of the laundry load may easily be determined from this peak and then be employed in calculation of the parameter representative of the rotational speed of the laundry load. Thus, the parameter representative of the rotational speed of the laundry may be obtained from the motor torque data in the frequency domain.

Figure 8:
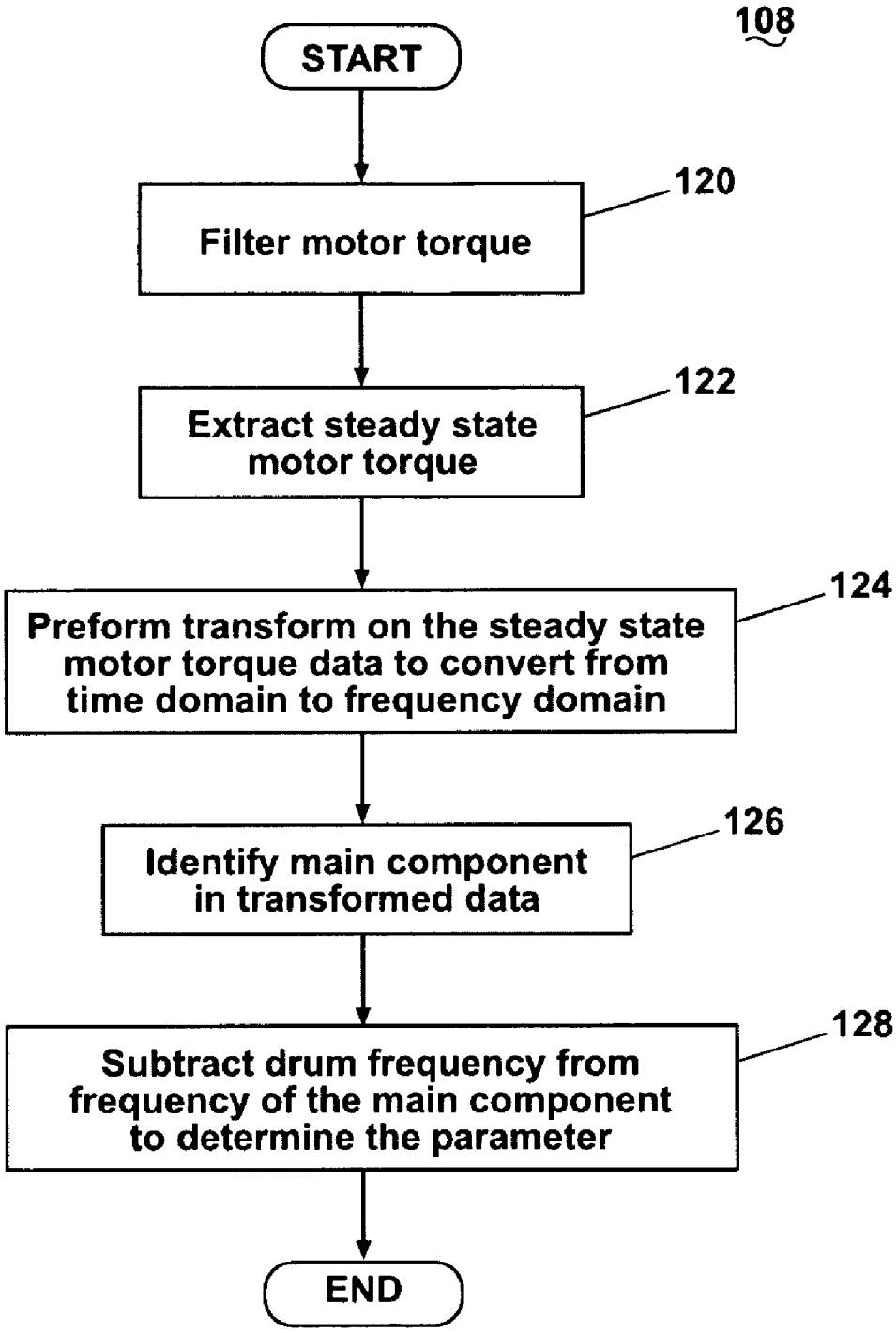
FIG. 8 is a flow chart for a method of determining a parameter representative of a rotational speed of the laundry load according to one embodiment for use in the method of FIG. 5.

The parameter representative of the rotational speed of the laundry load may be obtained from the motor torque data in the frequency domain in any suitable manner, and FIG. 8 provides a flow chart for an exemplary embodiment of a method for the step 108 of determining the parameter representative of the rotational speed of the laundry load. The embodiment shown in FIG. 8 uses the motor torque as the motor characteristic for illustrative purposes.

With the goal of converting the motor torque signal from time domain, such as the signal data from FIGS. 6A-6C, to frequency domain, such as the signal data from FIGS. 7A-7C, in order to determine the parameter, the embodiment of the method in FIG. 8 begins with filtering the motor torque in a step 120. As an example, the motor torque may be filtered by a first order analog hardware filter with a cutoff frequency of about 15.5 Hz before acquisition of the data. The data may be filtered again in the data acquisition process, such as by an eighth order Butterworth Infinite Impulse Response (IIR) filter with a cutoff frequency of about 12.5 Hz.

In a step 122, a steady state motor torque may then be extracted from the filtered motor torque obtained during the step 120. After finding the necessary signal, the mean, or dc component, may be calculated and subtracted from the original signal to remove the dc offset and an unwanted peak in a Fast Fourier Transform, which is discussed below, at 0 Hz.

After extraction of the steady state torque data, the data may be transformed from the time domain to the frequency domain in a step 124. In one embodiment, a Fast Fourier Transform (FFT) may be employed to transform or convert the steady state motor torque data.

One consideration before performing a FFT is length of the signal as the signal length can affect the outcome of the FFT. If the signal is too short, frequency resolution of the FFT spectrum may be too large to distinguish between closely spaced peaks. In some experiments, the collected data had a signal length of approximately two minutes, which provided good frequency resolution.

Another consideration before performing a FFT is windowing the data. Using a rectangular window or no window may give the best frequency resolution for a given signal length but will provide the worst dynamic range resolution, which is an ability to find small magnitude components among much bigger peaks. Good frequency resolution and good dynamic range resolution are conflicting needs; a window mainlobe width affects the frequency resolution while sidelobe height affects the dynamic range resolution, and a narrow mainlobe width results in better frequency resolution, while a lower sidelobe height result in better dynamic range resolution. These requirements are a trade-off because the sidelobe height increases as the mainlobe width decreases and vice-versa. For this embodiment of determining the parameter, a collection of closely spaced peaks are present in the FFT. The individual peaks may not be important, but the area in which the peaks occur is important, which led to the use of a window with a wide mainlobe that gives a smaller frequency resolution. However, the lack of frequency resolution is beneficial as the small closely spaced peaks blend together and appear as one wide peak, which, in turn, enables better estimation of the frequency for the overall peak. As an example, the window selected for the experimental data is the Blackman window, whose coefficients are given by:

$$\omega[k+1] = 0.42 - 0.5\cos\left(2\pi\frac{k}{n-1}\right) + 0.08\cos\left(4\pi\frac{k}{n-1}\right), k = 0, \ldots, n-1$$

After selection of the signal length and the window, the FFT may be calculated. Theoretically, the FFT is calculated from a periodic and discrete signal in the time domain and becomes discrete in the frequency domain. Due to the discrete nature, a FFT is generally plotted as a function of an index, k, rather than as a function of analog frequency, as in a Discrete Time Fourier Transform (DTFT). However, for practicality and ease of interpretation, the FFTs for the experimental data are plotted as a function of analog frequency, like a DTFT, in FIGS. 7A-7C.

Referring back to FIG. 8, the exemplary method for the step 108 of determining the parameter representative of the rotational speed of the laundry load continues at a step 126 of identifying a main component of the motor torque data in the frequency domain. The main component corresponds to the frequency at which the laundry load rotates within the drum 18, or the rotational speed of the laundry load in the frequency domain. In particular, the rotation of the laundry load in the drum 18 induces disturbances in the steady state motor torque, and the disturbances are sinusoidal due to inherent imbalance of the laundry load. The sinusoidal steady state motor torque appears in the magnitude FFT at its particular frequency, i.e., the main component, and the frequency of the sinusoidal steady state motor torque is also the frequency, or speed, of the rotating laundry load. For the experimental data for the 1, 3, and 4 kg laundry loads in FIGS. 7A-7C, the main components appear, respectively, just below than 1.25 Hz, just above 1 Hz, and just below 1 Hz, as indicated by the dash-dot-dash line in each of the figures.

Referring again to the FIG. 8 flow chart, following identification of the main component or frequency of the rotating laundry load, the frequency of the rotating drum 18 may be identified and subtracted from the main component to determine the parameter in a step 128. Thus, mathematically, the parameter may be the difference between the frequency of the rotating laundry load and the frequency of the rotating drum 18, as represented by:

$$\Delta f = f_L - f_D = \frac{\omega_L - \omega_D}{60},$$

wherein $f_L$ is the frequency of the rotating laundry load, or the main component, and $f_D$ is the frequency of the rotating drum 18. Physically, the parameter represents the difference between the rotational speed of the laundry load and the rotational speed of the drum, or, in other words, closeness of the speeds of the drum 18 and of the laundry load rotating in the drum 18. Because the main component, or the rotational speed of the laundry load, decreases with decreasing dry mass of the laundry load while the rotational speed of the drum 18 remains constant (i.e., the acquisition of the motor characteristic occurs while the drum 18 rotates at a predetermined speed), the parameter decreases with decreasing dry mass of the laundry load and may be indicative of the laundry load size. As the rotational speed of the laundry load decreases or approaches the rotational speed of the drum 18, the size or dry mass of the laundry load increases.

For the experimental data for the 1, 3, and 4 kg laundry loads in FIGS. 7A-7C, the rotational speed of the drum 18 is about 54 rpm, and, therefore, the frequency of the rotating drum 18 appears at about 0.9 Hz, as indicated by the dotted line in each of the figures. The parameter, which may be referred to as Δf, for each of the three laundry loads may then be determined by subtracting 0.9 Hz from the main component of each of the laundry loads.

Following determination of the parameter, such as by the method shown in FIG. 8 and described above, the laundry load size may be determined based on the parameter in the step 110 of the method 100 shown in FIG. 5. For example, the parameter may be compared to a reference, such as a reference based on empirical data, to determine the laundry load size. In one embodiment, the reference may include one or more ranges of the parameter, with each of the parameter ranges corresponding to a laundry load size, which may be a qualitative load size, such as small, medium, or large, or a quantitative dry mass, such as about 1, 3, and 5 kg. In another embodiment, the reference may be an equation into which the parameter may be inserted to calculate a dry mass of the laundry load.

Figure 9:
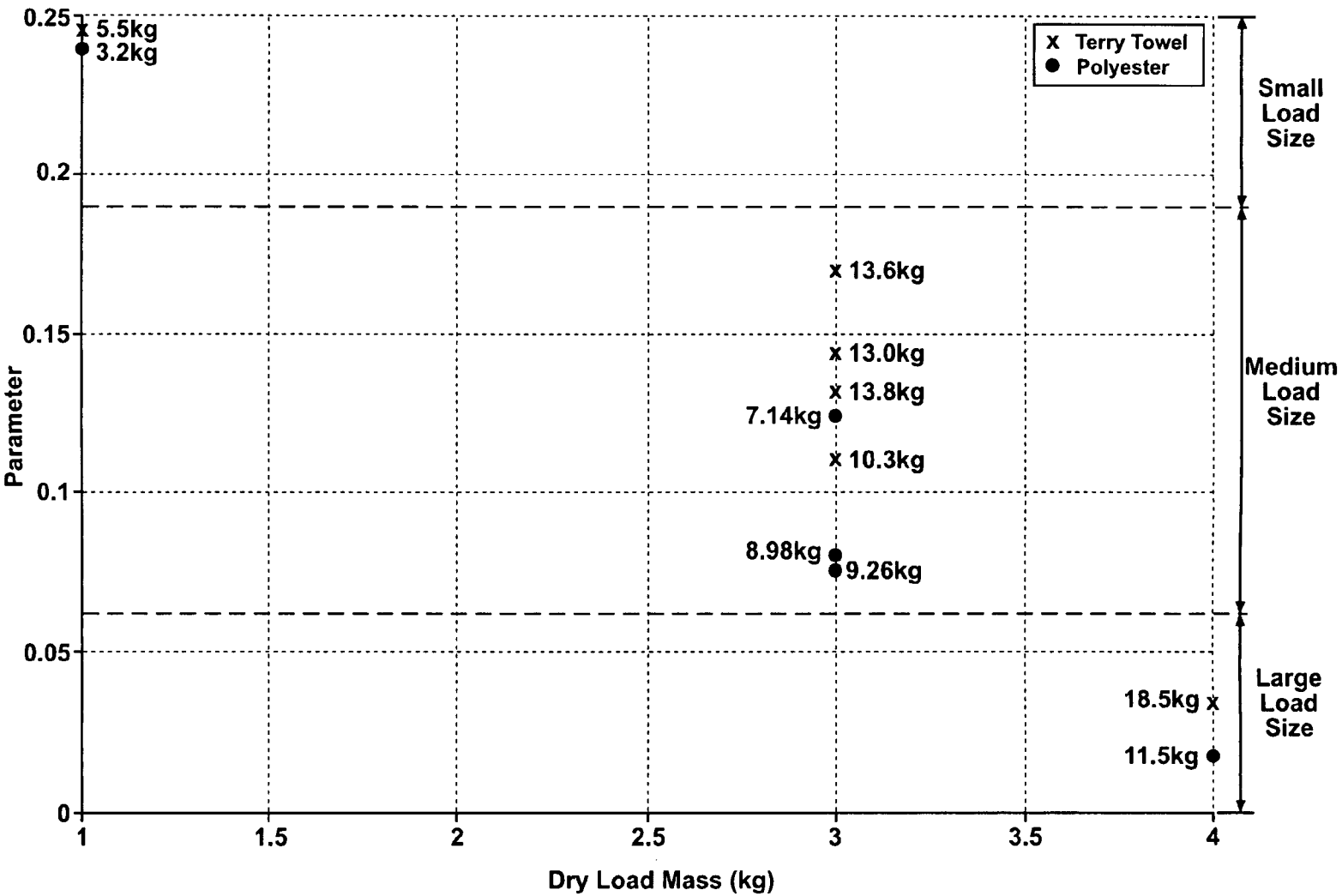
FIG. 9 is a graph of the parameter representative of a rotational speed of the laundry load determined using the method of FIG. 6 as a function of dry mass for laundry loads having varying wet masses according to one embodiment.

An example of using the parameter to determine the laundry load size is shown in FIG. 9, which is a plot providing the experimentally determined parameter for several laundry loads as a function of laundry load dry mass, wherein each of the laundry loads has a dry mass of about of 1, 3, or 4 kg. The x-axis of the plot represents laundry load dry mass, while the mass given next to each data point is the laundry load weight mass. The experimental data for each of the laundry loads was obtained while rotating the drum 18 at about 54 rpm with a wet laundry load. In the figure, it is apparent that the parameter for the smallest laundry loads (i.e., the 1 kg dry laundry loads) is relatively constant, regardless of fabric type and wet mass of the laundry load. The same behavior is observed for the largest laundry loads (i.e., the 4 kg dry laundry loads). Thus, the laundry load size for these laundry loads may be readily determined, either by assigning the dry mass or a qualitative size, such as small or large. While the parameter for the 3 kg dry mass laundry loads exhibits a larger range, the parameter nonetheless has been established as representative of the laundry load size such that the laundry load size may also be determined, either by assigning the dry mass or a qualitative size, such as medium.

The graph in FIG. 9 further illustrates the effects, or lack thereof, of fabric type and wet mass on the determination of the laundry load size based on the parameter. Different types of fabric retain differing amounts of liquid; therefore, laundry loads made of different fabric types but having the same dry mass may have different wet masses, wherein the laundry load having more absorbent fabrics has a greater wet mass. For example, in FIG. 9, a 3 kg polyester laundry load and a 3 kg terry towel laundry load have the same dry load mass, but, when saturated with liquid, the wet terry towel laundry load has a larger mass than the wet polyester laundry load (e.g., 5.5 kg versus 3.2 kg). Another example in FIG. 9 is two laundry loads, a terry towel laundry load and a polyester laundry load, having a 4 kg dry mass with a 7 kg difference between the wet laundry loads (e.g., 18.5 kg versus 11.5 kg). However, a laundry load has substantially the same radius whether the laundry load is dry or wet, which translates to substantially the same rotational speed and, therefore, substantially the same parameter. Because the parameter is substantially the same for the laundry load, whether dry or wet, the wet laundry load may be employed to determine the dry mass of the laundry load. In other words, for a given dry mass, the wet mass can vary significantly among laundry loads, such as due to differences in fabric type, without affecting the parameter.

To view this benefit of the method 100 in another manner, the wet mass of a laundry load does not negatively impact the determination of the load size, which may be a common problem with prior load size determination methods. For example, in FIG. 9, one terry towel laundry load has a wet mass of 10.3 kg, and one polyester laundry load has a wet mass of 11.5 kg; despite these laundry loads have relatively close wet masses, their parameters, which are about 0.02-0.03 and about 0.11-0.12, respectively, are not relatively close but are, rather, in correspondence with the parameter ranges for their respective dry masses of 3 kg and 4 kg. Thus, the method according to one embodiment is free of errors associated with the water absorbed by the clothes load, which is an error of prior methods.

In the embodiment of the method 100 described above and shown in the figures, the difference between the rotational speed of the laundry load and the rotational speed of the drum may be thought of as a difference between a parameter representative of the rotational speed of the laundry load and a parameter representative of the rotational speed of the drum 18. In this embodiment, the parameter representative of the rotational speed of the laundry load is the rotational speed of the laundry load in the frequency domain, and the parameter representative of the rotational speed of the drum 18 is the rotational speed of the drum 18 in the frequency domain. The difference between the two corresponds to the parameter representative of the laundry load from the step 108 of the method 100 in FIG. 5.

The method 100 described above and shown in the figures may be executed while rotating the drum at any predetermined rolling speed. In the embodiment described above, the drum 18 rotates at a steady state during the acquisition of the motor characteristic, and, in some embodiments, this corresponds to rotating the drum at a constant speed. The constant speed may be any constant speed that results in rolling of the laundry, but the constant speed should correspond to the constant speed, if any, employed to determine the reference. For example, if the reference is based on rotating the drum 18 at about 54 rpm, then the drum 18 should be rotated at about 54 rpm during data acquisition, but if the reference is based on rotating the drum 18 at about 40 rpm, then the drum 18 should rotate at about 40 rpm during data acquisition. The relative relationship between the rotational speed of the drum 18 and the rotational speed of the laundry load remains the same regardless of the rotational speed of the drum 18 for a given constant rotational speed of the drum 18.

In another embodiment of the method 100, the method 100 need not include the rotational speed of the drum 18 in the determination of the parameter representative of the rotational speed of the laundry load. As long as the drum 18 rotates at the predetermined rolling speed, the rotational speed of the laundry load in and of itself may be used to determine the load size, wherein the parameter representative of the rotational speed of the laundry load is the rotational speed of the laundry load or other measure of the rotational speed, such as the frequency.

While the embodiments described above employ motor torque as the motor characteristic employed for determining the laundry load size, the underlying theory for determining the load size relies on the rotational speed of the laundry load, and the method 100 may be adapted for acquiring, sensing, etc. the rotational speed of the laundry load and/or of the drum 18 in other manners. For example, the rotational speed of the laundry load and/or the drum 18 may be determined with a visual monitoring system, such as a system including one or more video cameras positioned to view the laundry load and/or the drum 18 during rotation thereof. The video cameras may be digital or analog, and the video output of the video cameras may be analyzed, such as with computer software, to calculate the rotational speeds of the laundry load and/or the drum 18. For example, a reference point on the object being measured may be identified at a reference location, and the time taken for the reference point to leave and return to the reference location may be calculated, such as by counting a number of video frames having a known acquisition rate between the time the reference point leaves and the time the reference point returns to the reference location. In another embodiment, a reference point on the object being measured may be identified at a first reference location, and a time taken to reach a second reference location a known distance from the first reference location may be determined, such as by counting video frames in the manner just described. In yet another embodiment, a distance traveled by a reference point on the object being measured between a pair of video frames having a known elapsed time may be calculated. Other methods of acquiring the rotational speed of the laundry load and/or the drum 18 are possible and within the scope of the invention.

The method 100 has been described with respect to the washing machine 10 in FIG. 1, which is a horizontal axis washing machine. However, the method 100 may be adapted for use with other types of washing machines, including horizontal axis washing machines having a tilted drum and vertical axis washing machines, and other types of laundry treating appliances. While some commercially available horizontal axis washing machines have a drum angled at about fifteen degrees, the drum angle may be smaller or greater. The particular algorithms, such as the algorithm for determining the parameter, employed in the method 100 may need to be adapted to accommodate the drum angle because the drum angle may affect the manner in which the laundry load interacts with the baffles and rolls within the drum. In a vertical axis washing machine, the method 100 may be employed if the laundry load is able to achieve a rolling behavior wherein the laundry load may be characterized as having a rotational speed. Again, the algorithms employed in the method 100 may need to be adapted for use in the vertical axis washing machine. Further, the method 100 may be adapted for use in other types of laundry treating appliances, including appliances that do not saturate the laundry, such as clothes dryers and laundry refreshing machines. Modifications to the algorithms may be necessary when employing the method 100 in these types of laundry treating appliances.

The embodiments of the method described herein for determination of laundry load size have industrial applicability for several reasons. The embodiments provide automatic laundry load size determination that employs existing components of the laundry treating appliance; the motor functions not only to rotate the drum but also as a sensor that provides data for use in determining the laundry load size, thereby eliminating the cost of additional sensors and the like. Further, with the automatic determination of the laundry load size, which may be more accurate than subjective input of a laundry load size by the user, the process settings for an operation cycle may be adaptive to a particular load size, which may lead to energy and resource savings (e.g., the cycle may employ appropriate amounts of water, cycle lengths, rotational speeds, steam use in steam dispensing appliances, chemistry use in chemistry dispensing appliances, detergent use in automatic detergent dispensing appliances, etc.). Additionally, the determination of the laundry load size may be conducted during normal operation of the laundry treating appliance such that the operation cycle need not be extended for the determination and that the laundry load may advantageously be wet for the determination of the laundry load dry mass.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method of operating a laundry treating appliance comprising a drum configured to hold laundry, the method comprising:

determining a rotational speed of the drum;

determining a rotational speed of the laundry inside the drum; comparing the rotational speed of the drum to the rotational speed of the laundry; and determining a laundry load size based on the comparison of the rotational speed of the drum and the rotational speed of the laundry.

2. The method according to claim 1 wherein the comparison is a difference between the rotational speed of the drum and the rotational speed of the laundry.

3. The method according to claim 2 wherein the difference is a difference between the rotational speed of the drum in a frequency domain and the rotational speed of the laundry in a frequency domain.

4. The method according to claim 3 wherein the drum is rotated by a motor, and the difference between the rotational speeds of the drum and the laundry are determined from a characteristic of the motor.

5. The method according to claim 4 wherein the characteristic of the motor is motor torque.

6. The method according to claim 4 wherein the characteristic of the motor is determined in a frequency domain.

7. The method according to claim 6 wherein a Fourier transform is used to convert the motor characteristic from a time domain to the frequency domain.

8. The method according to claim 2 wherein the laundry load size increases as the difference decreases.

9. The method according to claim 2 wherein the determining of the laundry load size based on the comparison comprises comparing the difference to predetermined ranges of the difference corresponding to predetermined laundry load sizes.

10. The method according to claim 1 wherein the laundry load size is a qualitative load size.

11. The method according to claim 1, further comprising wetting the laundry prior to determining the rotational speed of the laundry inside the drum.

12. The method according to claim 11 wherein the wetting of the laundry comprises saturating the laundry.

13. The method according to claim 1 wherein the laundry treating appliance is a washing machine.

14. The method according to claim 13 wherein the washing machine is a horizontal axis washing machine.

15. The method according to claim 1, further comprising operating the drum at a steady state while determining the rotational speed of the drum and determining the rotational speed of the laundry inside the drum.

16. The method according to claim 15 wherein the laundry comprises a plurality of individual fabric items, and the operation of the drum at the steady state causes substantially all of the individual fabric items to rotate as a collective body.

17. The method according to claim 15 wherein the operation of the drum at the steady state comprises rotating the drum at a constant rotational speed.

18. The method according to claim 17 wherein the constant rotational speed corresponds to rolling the laundry in the drum.

19. A method of operating a laundry treating appliance comprising a drum configured to hold laundry, the method comprising:

determining a parameter representative of a relationship between a rotational speed of the drum and a rotational speed of the laundry; and determining a laundry load size based on the parameter, wherein the relationship is a difference between the rotational speed of the drum and the rotational speed of the laundry.

20. The method according to claim 19 wherein the drum is rotated by a motor, and the difference between the rotational speeds of the drum and the laundry are determined from a characteristic of the motor.

21. The method according to claim 20 wherein the characteristic of the motor is motor torque.

22. The method according to claim 20 wherein the characteristic of the motor is in a frequency domain.

23. The method according to claim 22 wherein a Fourier transform is used to convert the motor characteristic from a time domain to the frequency domain.

24. The method according to claim 19 wherein the laundry load size increases as the parameter decreases.

25. The method according to claim 19 wherein the determining of the laundry load size based on the parameter comprises comparing the parameter to predetermined ranges of the parameter corresponding to predetermined laundry load sizes.

26. The method according to claim 19 wherein the laundry load size is a qualitative load size.

27. The method according to claim 19, further comprising wetting the laundry prior to determining the parameter.

28. The method according to claim 27 wherein the wetting of the laundry comprises saturating the laundry.

29. The method according to claim 19 wherein the laundry treating appliance is a washing machine.

30. The method according to claim 29 wherein the washing machine is a horizontal axis washing machine.

31. The method according to claim 19 wherein the determining of the parameter comprises determining the parameter from data obtained while operating the drum at a steady state.

32. The method according to claim 31 wherein the operation of the drum at the steady state comprises rotating the drum at a constant rotational speed.

33. The method according to claim 32 wherein the constant rotational speed corresponds to rolling the laundry in the drum.

34. The method according to claim 31 wherein the laundry comprises a plurality of individual fabric items, and the operation of the drum at the steady state causes substantially all of the individual fabric items to rotate as a collective body.

35. A method of operating a laundry treating appliance comprising a drum configured to hold laundry, the method comprising:

determining a parameter representative of a rotational speed of the laundry in the drum; determining a parameter representative of a rotational speed of the drum; comparing the parameter representative of the rotational speed of the laundry in the drum and the parameter representative of the rotational speed of the drum; and determining a laundry load size based on the parameter.

36. The method according to claim 35 wherein the comparing of the parameters comprises determining a difference between the parameters, and the determining of the laundry load size comprises basing the determination on the difference between the parameters.

37. The method according to claim 36 wherein the parameter representative of the rotational speed of the laundry in the drum is the rotational speed of the laundry in the drum in a frequency domain, and the parameter representative of the rotational speed of the drum is the rotational speed of the drum in a frequency domain.

38. The method according to claim 35 wherein the drum is rotated by a motor, and the parameter representative of the rotational speed of the laundry is determined from a characteristic of the motor.

39. The method according to claim 38 wherein the characteristic of the motor is motor torque.

40. The method according to claim 39 wherein the characteristic of the motor is in a frequency domain.

41. The method according to claim 39 wherein a Fourier transform is used to convert the motor characteristic from a time domain to a frequency domain.

42. The method according to claim 35 wherein the laundry load size increases as the parameter representative of the rotational speed of the laundry load decreases.

43. The method according to claim 35 wherein the laundry load size is a qualitative load size.

44. The method according to claim 35, further comprising wetting the laundry prior to determining the parameter.

45. The method according to claim 44 wherein the wetting of the laundry comprises saturating the laundry.

46. The method according to claim 35 wherein the laundry treating appliance is a washing machine.

47. The method according to claim 46 wherein the washing machine is a horizontal axis washing machine.

48. The method according to claim 35 wherein the determining of the parameter comprises determining the parameter from data obtained while operating the drum at a steady state.

49. The method according to claim 48 wherein the operation of the drum at the steady state comprises rotating the drum at a constant rotational speed.

50. The method according to claim 49 wherein the constant rotational speed corresponds to rolling the laundry in the drum.

51. The method according to claim 48 wherein the laundry comprises a plurality of individual fabric items, and the operation of the drum at the steady state causes substantially all of the individual fabric items to rotate as a collective body.

* * * * *

UNITED STATES PATENT AND TRADEMARK OFFICE

CERTIFICATE OF CORRECTION

PATENT NO. : 8,166,590 B2
APPLICATION NO. : 12/424629
DATED : May 1, 2012
INVENTOR(S) : Farhad Ashrafzadeh et al.

It is certified that error appears in the above-identified patent and that said Letters Patent is hereby corrected as shown below:

Col. 14, lines 31 - 40, Claim 35: "A method of operating a laundry treating appliance comprising a drum configured to hold laundry, the method comprising: determining a parameter representative of a rotational speed of the laundry in the drum; determining a parameter representative of a rotational speed of the drum; comparing the parameter representative of the rotational speed of the laundry in the drum and the parameter representative of the rotational speed of the drum; and determining a laundry load size based on the parameter." - should be Claim 35: -- A method of operating a laundry treating appliance comprising a drum configured to hold laundry, the method comprising: determining a parameter representative of a rotational speed of the laundry in the drum; determining a parameter representative of a rotational speed of the drum; comparing the parameter representative of the rotational speed of the laundry in the drum and the parameter representative of the rotational speed of the drum; and determining a laundry load size based on the parameters. --

Signed and Sealed this
Thirtieth Day of October, 2012

David J. Kappos

David J. Kappos
*Director of the United States Patent and Trademark Office*